US005690125A

United States Patent [19]

Niemann et al.

[11] Patent Number: 5,690,125

[45] Date of Patent: Nov. 25, 1997

[54] APPARATUS FOR IMPARTING COMBINED SIDEWISE AND ROTARY MOVEMENTS TO RECEPTACLES FOR ROD-SHAPED SMOKERS' PRODUCTS

[75] Inventors: Helmut Niemann, Ahrensburg; Nikolaus Häusler, Wohltorf, both of Germany

[73] Assignee: Hauni Maschinenbau AG, Hamburg, Germany

[21] Appl. No.: 704,366

[22] Filed: Aug. 28, 1996

[30] Foreign Application Priority Data

Sep. 7, 1995 [DE] Germany ..... 195 32 943.0

[51] Int. Cl.[6] ..... A24C 5/60

[52] U.S. Cl. ..... 131/281; 219/121.6; 198/474.1; 198/363.2; 198/377; 131/94; 131/282

[58] Field of Search ..... 198/474.1, 363.2, 198/377; 219/121.6; 131/281, 94, 282

[56] References Cited

U.S. PATENT DOCUMENTS

| | | | |
|---|---|---|---|
| 4,168,773 | 9/1979 | Thiel et al. | 198/479 |
| 4,265,254 | 5/1981 | Koch et al. | 131/281 |
| 4,281,670 | 8/1981 | Heitmann | 131/281 |
| 5,431,274 | 7/1995 | Schaupp | 198/474.1 |

FOREIGN PATENT DOCUMENTS

| | | | |
|---|---|---|---|
| A-2 560 171 | 8/1985 | France | 131/281 |
| A-41 08 166 | 9/1992 | Germany | 131/281 |
| A-2 119 223 | 11/1983 | United Kingdom | 131/281 |
| A-2 167 935 | 6/1986 | United Kingdom | 131/281 |

OTHER PUBLICATIONS

European Search Report of Nov. 25, 1996 re Aplication No. 96 11 3591.

*Primary Examiner*—Aaron J. Lewis
*Assistant Examiner*—Charles W. Anderson
*Attorney, Agent, or Firm*—Darby & Darby

[57] ABSTRACT

Apparatus for imparting rotary and sidewise movements to receptacles for cigarettes has a rotary conveyor carrying pairs of levers pivotable about discrete axes which are parallel to and surround the axis of the conveyor. One lever of each pair is pivotable about the respective discrete axis relative to the conveyor under the action of a stationary cam which is tracked by a follower on the lever, and each pair of levers carries two shafts for a receptacle. The shafts are caused to turn the respective receptacles through at least 360° while the receptacles are located at a perforating station where the wrappers of the cigarettes therein are perforated by a stationary laser; at such time, the cam causes the corresponding pair of levers to pivot their receptacles counter to the direction of rotation of the conveyor so that the cigarettes are held against orbital movement while the respective receptacles are being rotated by gear trains installed in selected levers and receiving motion from pivots for such levers.

20 Claims, 5 Drawing Sheets

A
A
B
1
2
3
4
5
6
8
9
13
14
16
18
19
21
22
23
24
26
27
28
29
31
32
44
46
47
48
49
51
52

APPARATUS FOR IMPARTING COMBINED SIDEWISE AND ROTARY MOVEMENTS TO RECEPTACLES FOR ROD-SHAPED SMOKERS' PRODUCTS

BACKGROUND OF THE INVENTION

The invention relates to apparatus for manipulating plain or filter cigarettes, cigars, cigarillos and/or filter rod sections in general, and more particularly to improvements in apparatus for imparting composite movements to such articles or products of the tobacco processing industry. Still more particularly, the invention relates to improvements in apparatus for imparting combined sidewise and rotary movements to rod-shaped articles, such as plain or filter cigarettes (hereinafter referred to as cigarettes or filter cigarettes).

A so-called filter tipping machine is designed to assemble plain cigarettes and filter rod sections into filter cigarettes. As a rule, such machines are designed to produce filter cigarettes of double unit length (with two coaxial plain cigarettes of unit length and a filter rod section or filter plug of double unit length between them), and the articles are then severed midway across their filter plugs to yield pairs of filter cigarettes of unit length.

The treatment or processing of filter cigarettes of unit length or multiple unit length often necessitates rotation of the articles about their longitudinal axes. For example, a filter cigarette which is caused to rotate about its own axis is much more likely to be accurately tested in order to ascertain its diameter, its exact cross-sectional outline, the integrity or lack of integrity of its wrapper, the permeability of its wrapper, the presence or absence of smudges at the exterior of its wrapper, the condition of the uniting band of tipping paper which is convoluted around the filter mouthpiece of double unit length and the adjacent end portions of the two plain cigarettes of unit length, and/or other characteristics or parameters of such articles.

Another very important treatment of cigarettes involves the enhancement of the permeability of selected portions of the wrappers of such articles. As a rule, the enhancement involves the making of perforations in selected portions of the wrappers during advancement of articles past a stationary instrument or implement. The perforations are normally formed in arrays constituting one or more annuli extending in the circumferential directions of the articles. Thus, it is necessary to rotate each cigarette about its own axis while it is being advanced sideways (i.e., transversely of its central longitudinal axis) past the perforating station. The making of perforations is considered to be desirable in order to ensure the penetration of cool atmospheric air into the column of tobacco smoke flowing from the lighted end of a cigarette into the smoker's mouth. The inflowing atmospheric air is believed to exert a beneficial influence upon the nicotine and/or condensate content of tobacco smoke. As a rule, the perforations are provided in the convoluted uniting band surrounding the filter mouthpiece close to the adjacent end of the plain cigarette forming part of the respective filter cigarette.

At the present time, the making of perforations in the wrappers of cigarettes is carried out by resorting to electrically operated spark generating instruments but particularly by resorting to lasers which are designed to meet the necessary qualitative and quantitative requirements for the making of requisite numbers of perforations in a desired distribution in desired or selected portions of the wrappers.

Reference may be had, for example, to commonly owned U.S. Pat. No. 4,281,670 granted Aug. 4, 1981 to Uwe Heitmann et al. for "APPARATUS FOR INCREASING THE PERMEABILITY OF WRAPPING MATERIAL FOR ROD-SHAPED SMOKERS' PRODUCTS" which discloses a laser and a system of conveyors serving to transport successive cigarettes past the perforating station in such a way that a cigarette being acted upon by coherent radiation is caused to turn about its own axis and to temporarily interrupt its movement with that conveyor which actually serves to advance cigarettes toward and beyond the perforating station. A drawback of the patented apparatus is that cigarettes are apt to be subjected to relatively rough treatment because they must rotate with reference to their respective receptacles.

A somewhat similar apparatus is disclosed in commonly owned copending U.S. Pat. No. 4,265,254 granted May 5, 1981 to Franz-Peter Koch et al. for "APPARATUS FOR PERFORATING CIGARETTE PAPER OR THE LIKE".

The disclosures of the above US patents are incorporated herein by reference.

OBJECTS OF THE INVENTION

An object of the invention is to provide a novel and improved apparatus for imparting combined sidewise (transverse) and rotary movements to rod-shaped smokers' products, and more specifically to receptacles for such smokers' products.

Another object of the invention is to provide an apparatus which can be readily installed in the existing machines and/or production lines for the making of plain or filter cigarettes, cigarillos, cigars and/or filter rod sections and/or other types of rod-shaped smokers' products.

A further object of the invention is to provide an apparatus which can be utilized with advantage for the transport of filter cigarettes past one or more permeability enhancing units in a filter tipping machine.

An additional object of the invention is to provide a machine or a production line which embodies the above outlined apparatus.

Still other object of the invention is to provide an apparatus which can convey rod-shaped articles at a high frequency and which can treat the conveyed articles gently prior to, during and subsequent to advancement past one or more treating or processing stations.

A further object of the invention is to provide the apparatus with novel and improved means for imparting several different movements to receptacles for rod-shaped articles of the tobacco processing industry.

Another object of the invention is to provide novel and improved transmissions for use in the above outlined apparatus.

An additional object of the invention is to provide the apparatus with novel and improved means for regulating the speed and/or the direction of movement of receptacles for rod-shaped articles in filter tipping and/or other machines for the making and/or processing of rod-shaped articles of the tobacco processing industry.

Still another object of the invention is to provide a novel and improved method of manipulating rod-shaped articles during transport past one or more testing, inspecting and/or perforating units.

A further object of the invention is to provide an apparatus which constitutes an improvement over and a further development of apparatus disclosed in the aforediscussed US patents.

Another object of the invention is to provide an apparatus which can convey rod-shaped articles at a frequency that is necessary to take full advantage of the capacity of one or more tools, implements, instruments and/or other units which are used to inspect, test, perforate the wrappers of and/or otherwise influence the characteristics of rod-shaped articles in modern high-speed machines or production lines for the making and/or processing of plain or filter cigarettes, cigars or cigarillos, filter rod sections and/or other rod-shaped articles of the tobacco processing industry.

SUMMARY OF THE INVENTION

The invention is embodied in an apparatus for manipulating receptacles for elongated rod-shaped articles of the tobacco processing industry during transport of receptacles relative to and at an article treating station. The apparatus comprises means for conveying the receptacles in a predetermined direction along an arcuate path at least substantially transversely of the elongated articles in the receptacles, means for temporarily moving the receptacles counter to the predetermined direction relative to the conveying means at the treating station, and means for rotating the receptacles about longitudinal axes for the receptacles at least during temporary movement of the receptacles relative to the conveying means counter to the predetermined direction.

The receptacles are or can be configurated in such a way that they are provided with flutes for rod-shaped articles.

The apparatus further comprises at least one unit which is disposed at the treating station and is or can be provided with means for influencing the permeability of tubular wrappers of articles in the receptacles being located at the treating station. The means for influencing can comprise one or more lasers.

It is preferred to employ rotating means which is designed to turn each receptacle through an angle of at least 360°.

The conveying means can comprise means for orbiting the receptacles about a fixed axis so that the longitudinal axes are being conveyed at a first speed, and the means for temporarily moving can include means for moving the receptacles counter to the predetermined direction so that the longitudinal axes are moved at a second speed at least approximating the first speed. This ensures that the positions of the receptacles at the treating station —as seen in the predetermined direction—remain at least substantially fixed during rotation of the receptacles and of the articles therein about the respective longitudinal axes.

The conveying means, the means for temporarily moving the receptacles counter to the predetermined direction and the rotating means can jointly constitute an integral power train. The arrangement can be such that at least one of these three (conveying, temporarily moving and rotating) means receives motion from another of the three means.

As mentioned above, the conveying means can comprise means for orbiting the receptacles about a fixed axis, and the means for temporarily moving can include at least one lever for each receptacle. The levers orbit about the fixed axis and are pivotable relative to the conveying means about further axes which are parallel to the fixed axis. The receptacles are rotatable relative to the corresponding levers about the respective longitudinal axes. The means for conveying can comprise a housing and drive means for rotating the housing about the fixed axis, and the means for temporarily moving can further comprise pivots which define the further axes and are rotatably mounted in the housing, and a cam follower rigid with each pivot. Still further, such means for temporarily moving can comprise a stationary cam having one or more tracks for the followers. For example, the cam can be provided with first and second tracks, and each follower can be provided with first and second rollers which travel along the respective tracks when the housing of the conveying means is rotated about the fixed axis.

The levers of the means for temporarily moving the receptacles counter to the predetermined direction are pivotable relative to the conveying means and rotatably support the respective receptacles, and such levers can include or constitute cases for transmissions of the rotating means. Each such transmission can include a sun gear fixed to the pivot which rockably mounts the respective lever in the conveying means, and a further gear which receives torque from the sun gear (such as by way of one or more intermediate gears) and is affixed to a shaft defining the longitudinal axis for the respective receptacle.

The longitudinal axes for the receptacles are preferably offset relative to the central longitudinal axes of the articles therein; this can be achieved by providing each receptacle with an offset which ensures that the longitudinal axis for the receptacle (and more specifically the longitudinal axis of the shaft for such receptacle) is radially offset relative to and parallel with the central axis of the article in the receptacle.

Each receptacle can comprise two aligned portions or sections, and the means for temporarily moving then includes means for coupling the aligned sections of each receptacle to each other for synchronous rotation about the respective longitudinal axis. The means for coupling can include two coaxial pivots for each receptacle each of which is indirectly connected (by a lever and a pivot) to one of the two sections of such receptacle. The pivots form part of the means for moving the receptacles, and the coupling means can further comprise muffs or sleeves which non-rotatably receive portions of two coaxial pivots to ensure that the thus coupled pivots rotate as a unit and drive the sections of the respective receptacle at a desired speed.

The means for conveying can comprise a drum which is rotatable about the fixed axis and carries the means for temporarily moving the receptacles counter to the predetermined direction. The drum further carries the means for rotating as well as the receptacles.

The receptacles can be constructed, assembled and designed to receive and transport filter cigarettes of double unit length, preferably in such a way that the convoluted wrappers for the filter mouthpieces of such cigarettes are fully exposed for the application of perforations and/or for other treatment or processing.

The receptacles preferably comprise means for pneumatically holding the articles for movement along the predetermined path.

The means for temporarily moving can be designed in such a way that a receptacle approaching the treating station is moved relative to the means for conveying in the predetermined direction prior to movement counter to the predetermined direction.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
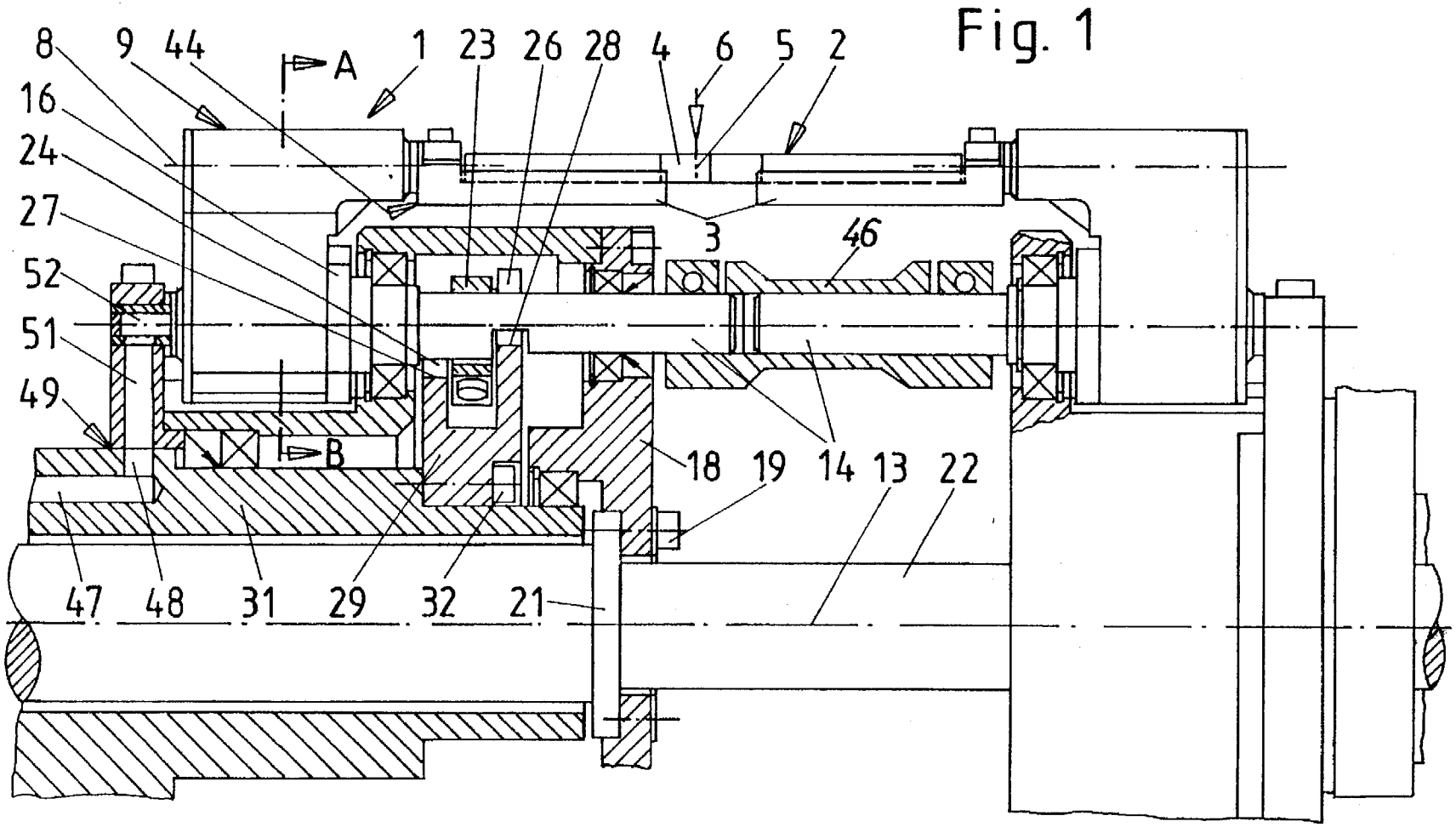
FIG. 1 is a fragmentary partly elevational and partly axial sectional view of an apparatus which can form part of a filter tipping machine and embodies one form of the present invention.
Figure 2:
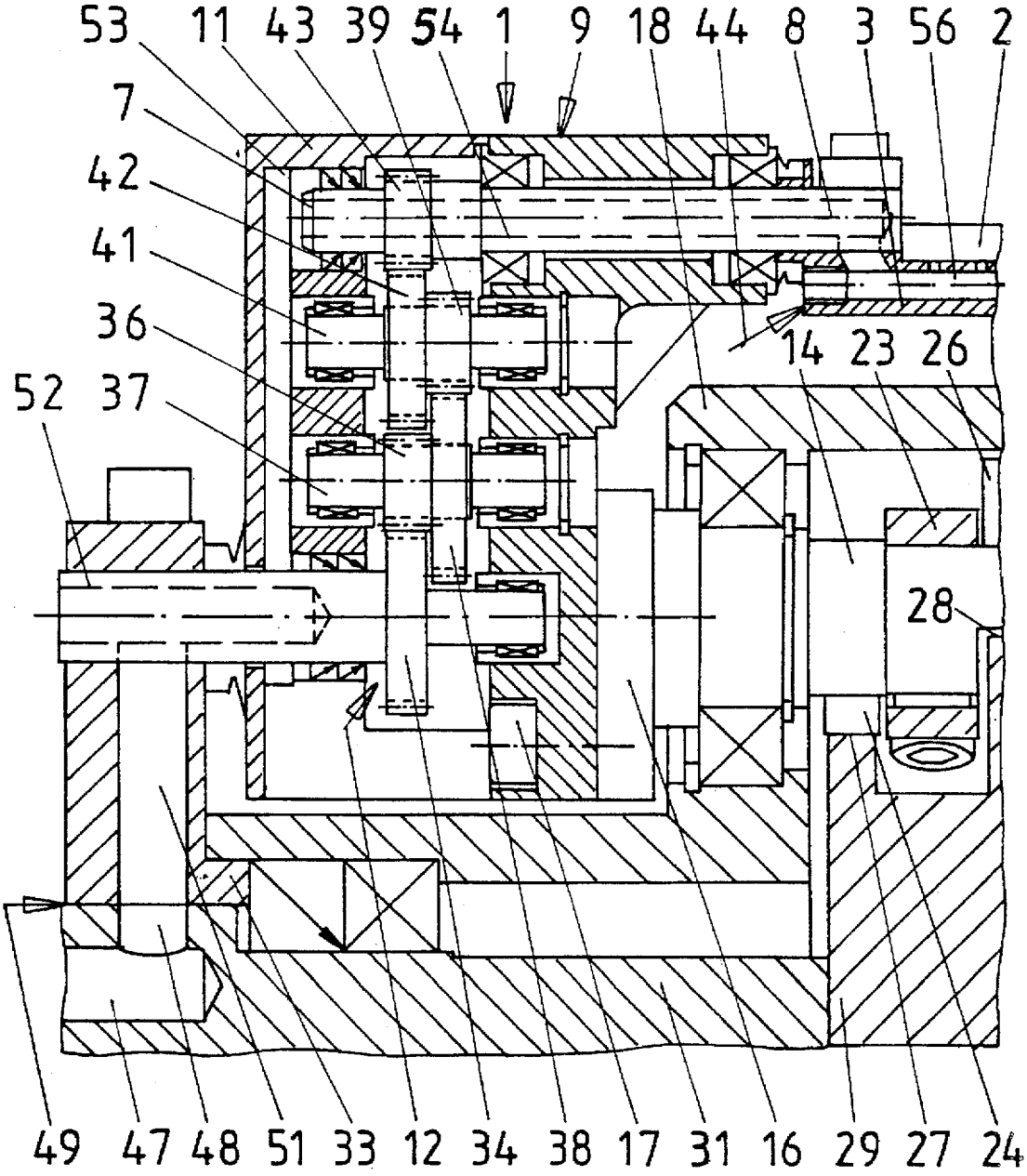
FIG. 2 is an enlarged view of a detail in the structure of FIG. 1, with the case for a gear train shown in section as seen in the direction of arrows from the line A–B in FIG. 1.
Figure 3:
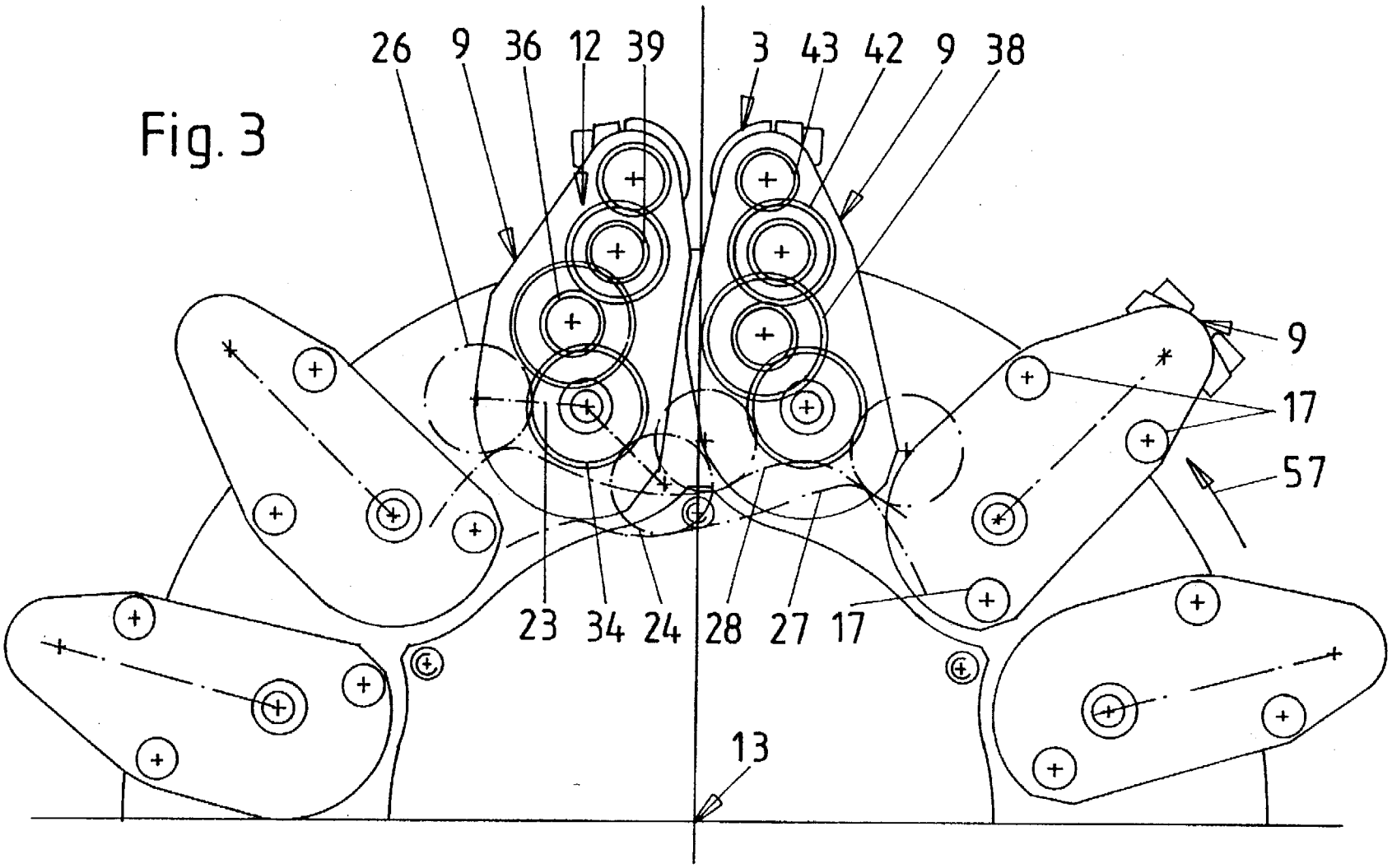
FIG. 3 is a fragmentary end elevational view of the apparatus which is shown in FIG. 1.

Referring first to FIGS. 1, 2, and 3, there is shown a portion of an apparatus which is designed to transport successive filter cigarettes 2 of double unit length toward and beyond a treating station occupied by a stationary unit (denoted by an arrow 6) which serves to influence the permeability of selected portions of the wrappers of the cigarettes. For example, the unit denoted by the arrow 6 can constitute or comprise one or more lasers which are constructed, assembled and installed to provide the wrapper (convoluted uniting band) 4 for the filter rod section of each cigarette 2 with one or more annuli of perforations 5 by directing one or more beams of coherent radiation against the cigarette.

Figure 4:
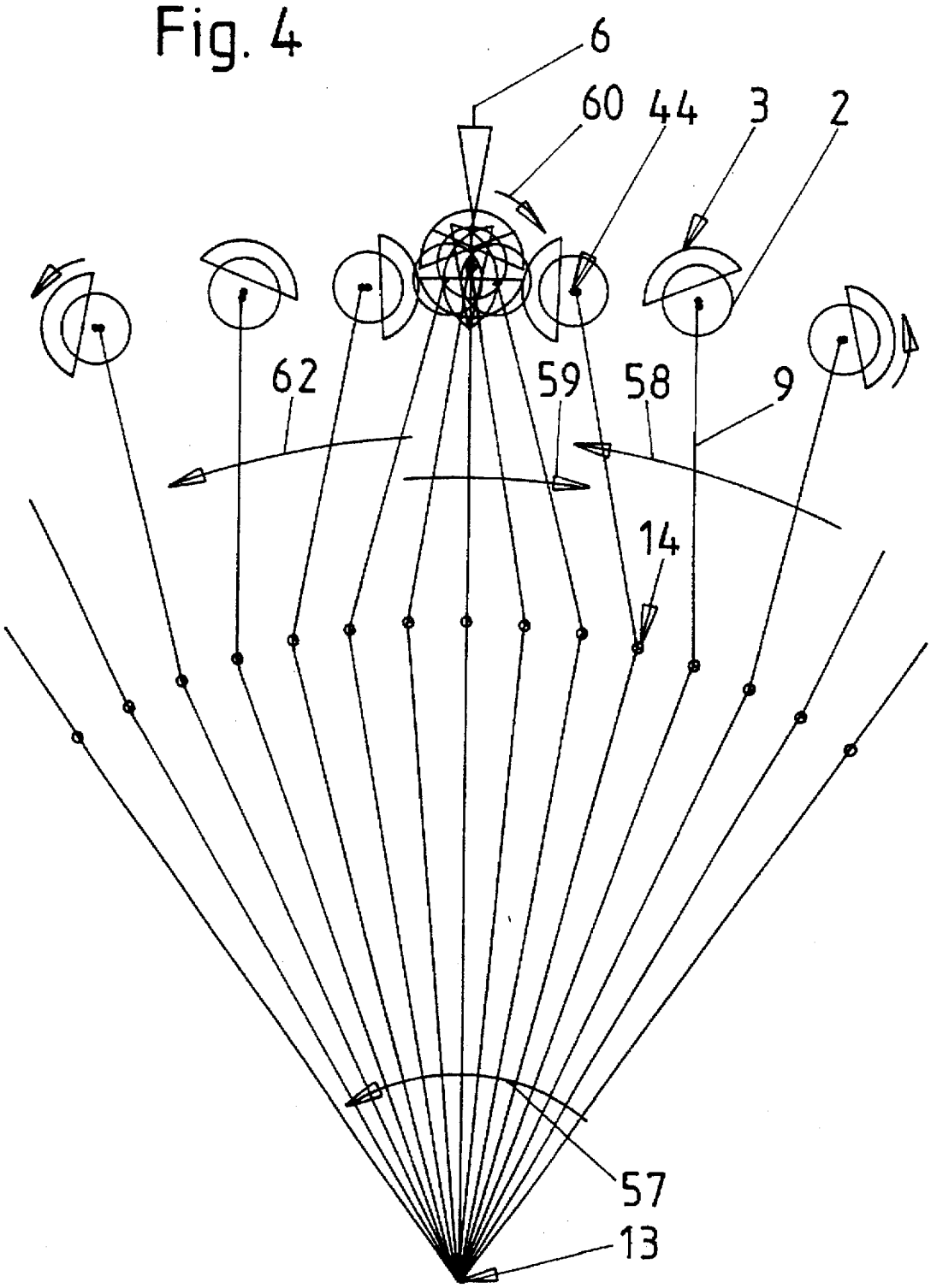
FIG. 4 is a diagram showing the positions of receptacles for rod-shaped articles during movement toward, during dwell at and during movement beyond the treating unit.
Figure 5:
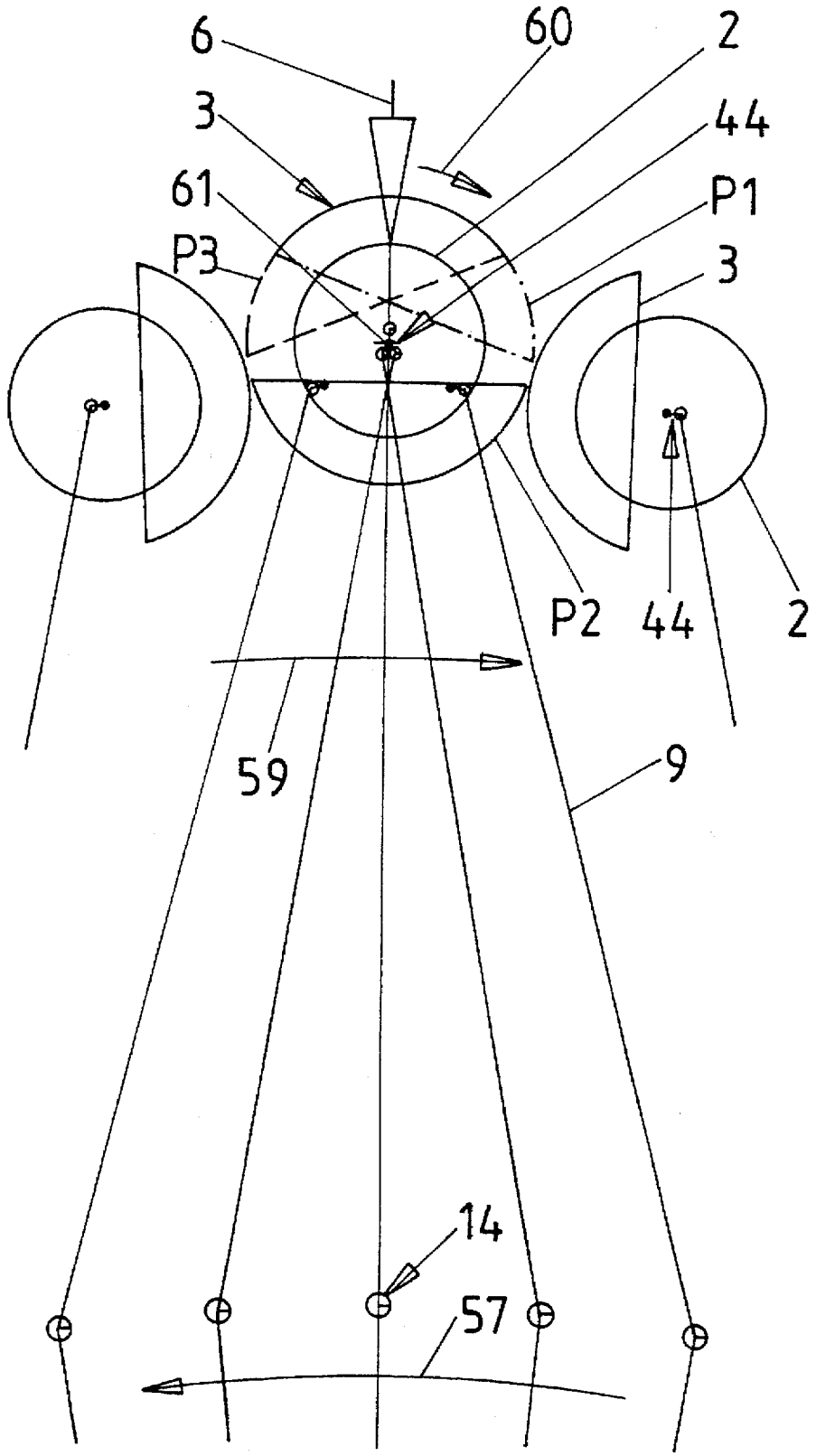
FIG. 5 is an enlarged view of a detail in the diagram of FIG. 4.

The apparatus comprises a drum-shaped conveyor 1 which is rotatable about a fixed axis 13 in a counterclockwise direction, as seen in FIGS. 3, 4 and 5 (note the arrow 57), and carries an annulus of elongated axially parallel two-piece or two-section receptacles 3 having flutes wherein the cigarettes 2 are held pneumatically (by suction) during conveying by the conveyor 1 along a certain portion of an arcuate path having its center of curvature on the axis 13.

In order to ensure that the unit (hereinafter called laser) 6 can provide each wrapper 4 with at least one annulus of perforations 5, the cigarette 2 which reaches the treating station must be temporarily held against movement in the direction of the arrow 57 and must be caused to rotate about its central longitudinal axis while the wrapper 4 is exposed to the action of one or more beams of coherent radiation. Therefore, the improved apparatus further comprises novel and improved means for temporarily moving the receptacles 3 and the cigarettes 2 therein counter to the direction indicated by the arrow 57 (note the arrow 59 in each of FIGS. 4 and 5) while a cigarette 2 is being acted upon by radiation, and means for rotating the receptacle 3 at the treating station about a longitudinal axis (shown at 8 in each of FIGS. 1 and 2) which parallel to but is radially spaced apart from the axis 13 of the conveyor 1. In other words, the receptacles 3 are caused to orbit about the axis 13, they are caused to move counter to the direction of rotation of the conveyor 1 during their dwell in the range of the laser 6, and the receptacles are caused to turn through not less (or not appreciably less) than 360° during dwell at the treating station. The length of the interval of dwell at the treating station depends on the number of receptacles 3 on the conveyor 1, on the minimum time required to complete the rotation of a receptacle 3 about the respective longitudinal axis 8 without affecting the quality of the perforating operation, and on the desired output of the machine or production line which embodies the improved apparatus. The illustrated conveyor 1 can form part of a filter tipping machine wherein pairs of plain cigarettes of unit length are connected with filter mouthpieces or filter rod sections of double unit length by adhesive coated uniting bands of tipping paper which are convoluted around the filter mouthpieces and around the adjacent inner end portions of the plain cigarettes to form tubular wrappers 4 which convert each pair of plain cigarettes of unit length and the respective filter mouthpiece of double unit length into a filter cigarette 2 of double unit length. However, the improved apparatus can be utilized with equal advantage for the making of perforations in and/or for other treatment of other types of rod-shaped articles of the tobacco processing industry, such as filter mouthpieces of selected length, plain cigarettes of unit length, filter cigarettes of unit length and/or others.

The means for rotating a receptacle 3 about the respective axis 8 comprises two coaxial shafts 7 which together define the axis 8 and are rotatably mounted on discrete levers or arms 9 indirectly carried by a housing 18 of the conveyor 1. As can be seen in FIG. 1, each receptacle 3 comprises two similar or identical portions or sections which are spaced apart from each other in the direction of the respective axis 8 in order to fully expose the wrapper 4 of the cigarette 2 in the receptacle for the making of one or more complete annuli of perforations 5, or to expose at least that portion of a wrapper 4 at the treating station which is to be provided with perforations. It is also possible to employ means for forming at least two annuli of operations, one in that portion of a wrapper 4 which surrounds the inner end portion of a first plain cigarette and the other in that portion of the same wrapper which surrounds the inner end portion of the second plain cigarette of the filter cigarette 2.

The means for rotating a receptacle 3 further comprises a transmission 12 (shown in the form of a gear train) which is installed in a hollow case 11 forming part of or constituting one of the two levers 9 for a receptacle 3. The gear train 12 operates between a pivot 14 for the respective lever 9 and one of the two shafts 7 for the respective receptacle. The pivots 14 are elongated shafts which are rigidly secured to the corresponding levers 9 (such as to the cases 11 of the levers) by the flanges 16 (which are of one piece with or are rigidly secured to the pivots 14) and by fasteners 17 which affix the flanges 16 to the respective levers 9. Each pivot 14 is rotatably journalled in the housing 18 of the conveyor 1, and such housing is rotated in the direction of the arrow 57 by a drive shaft 22 which defines the fixed axis 13 and carries one or more flanges 21 affixed to the housing 18 by one or more threaded or other suitable fasteners 19.

Each pivot 14 is rigidly connected with a discrete two-armed follower 23 having free end portions carrying the rollers 24, 26 which respectively follow the endless tracks 27, 28 defined by a stationary cam 29. This cam, its tracks 27, 28, and the followers 23 with their pairs of rollers 24, 26 also form part of means for temporarily moving the receptacles 3 relative to the conveyor 1 counter to the direction indicated by the arrow 57 while the receptacles are located at the testing station, i.e., while the respective cigarettes 2 are being rotated about the corresponding axes 8 and are being acted upon by the beam or beams of coherent radiation issuing from the laser 6. The cam 29 is secured to a stationary casing 31 for the conveyor 1 by screws 32 and/or other suitable fasteners. The cam 29 and its tracks 27, 28, the pivots 14 and the followers 23 with their rollers 24, 26 can be said to constitute a cam and follower assembly or transmission which, in turn, forms part of an integrated power train including the shaft 22 of the conveyor 1, the means for temporarily moving the receptacles 3 in the direction of the arrow 59 (while the shaft 22 continues to rotate the housing 18 in the direction of the arrow 57), and the means for rotating the receptacles 3 about the respective axes 8.

Each gear train 12 includes a holder 33 which is rigidly affixed to the housing 18 and receives one portion of a shaft of a sun gear 34 which shaft is journalled in the respective pivot 14. The sun gear 34 is located in the case 11 of the respective lever 9 and mates with a gear or pinion 36 mounted on an intermediate shaft 37 journalled in the respective case 11. A gear 38 which is rotatable with the intermediate shaft 37 and with the pinion 36 meshes with a pinion or gear 39 on a further intermediate shaft 41 which is journalled in the case 11, and a gear 42 which is rigid with the intermediate shaft 41 and pinion 39 mates with a gear or pinion 43 on the respective shaft 7.

That portion of that section of a receptacle 3 which is affixed to a driven shaft 7 (i.e., to the shaft journalled in a transmission case 11 containing a gear train 12) is provided with an offset part 44 which ensures that the central longitudinal axis of a cigarette 2 being pneumatically held in the flute of the receptacle 3 is parallel to and radially spaced apart from the corresponding axis 8. The importance of the offset part 44 will be pointed out hereinafter in connection with the mode of operation of the improved apparatus.

The aforementioned power train can be said to include the shaft 22 and the housing 18 of the conveyor 1, the pivots 14, the transmissions each of which includes a follower 23 and the cam 29 (which is common to all followers), the levers 9, and the gear trains 12. The components of this power train are interlinked or synchronized in such a way that the levers 9 are caused to move the respective receptacles 3 in the direction of the arrow 59 as soon as the receptacles arrive at the treating station (where the respective cigarettes 2 are being acted upon by radiation issuing from the laser 6), and that the receptacles 3 are caused to turn through at least 360° while moving (relative to the conveyor 1) in the direction of the arrow 59, i.e., during temporary dwell at the treating station. All movements are or can be derived from the drive shaft 22 for the housing 18 of the conveyor 1 and from the stationary cam 29.

The movements of the driven section of a receptacle 3 and of the aligned non-driven section of the same receptacle are synchronized by one of the coupling elements 46 in the form of a sleeve or muff which connects the two pivots 14 for each receptacle to one another in a manner as shown in FIG. 1. This ensures that the right-hand lever for the receptacle 3 of FIG. 1 (and more particularly for the right-hand shaft 7 for such receptacle) is compelled to share all movements of the left-hand lever 9, i.e., of the lever which comprises a case 11 for a transmission or gear train 12. Of course, it is also possible to provide two gear trains 12 for each receptacle 3, one in each of the respective levers.

The means for temporarily retaining cigarettes 2 in the flutes of the respective two-piece receptacles 3 comprises a suction generating device (e.g., a fan, not shown) having a suction side connectable to channels 47 in the stationary casing 31, one for each receptacle 3. Each channel 47 communicates with a radially outwardly extending channel 48 communicating (during certain stages of each revolution of the shaft 22) with one of several radially outwardly extending channels 51 in the rotary part of the conveyor 1 by way of a suitable valve plate having a control slot 49. Each channel 51 communicates with a longitudinally extending channel 56 in the respective receptacle 3 by way of additional channels 52, 53, 54, and each channel 56 can draw air from the flute of the respective receptacle 3 by way of ports (shown but not referenced) at the deepmost zone of the flute of such receptacle. The exact construction of the pneumatic system for temporarily holding cigarettes 2 in the flutes of the respective receptacles 3 forms no part of the present invention.

The mode of operation of the apparatus which is shown in FIGS. 1 to 3 is as follows:

The shaft 22 drives the housing 14 of the conveyor 1 in the direction of the arrow 57 so that the receptacles 3 are caused to orbit about the axis 13 along an arcuate path. Successive empty receptacles 3 receive fresh (untreated) cigarettes 2 during advancement along a first portion of such arcuate path (upstream of the station for the laser 6), and such cigarettes are held in the flutes of their receptacles 3 by suction during advancement toward, during dwell at, and during advancement beyond the laser 6 to a removing or evacuating station where the freshly treated cigarettes 2 are transferred into the flutes of a further rotary conveyor (not shown), onto a belt conveyor or onto any other suitable transporting assembly.

During advancement toward the treating station, the rollers 24, 26 of successive followers 23 engage cylindrical or substantially cylindrical portions of the respective tracks 27, 28 on the stationary cam 29 so that the orientation of the corresponding levers 9 relative to the rotating housing 18 does not change at all or changes only negligibly. The levers 9 then extend substantially radially outwardly as shown in the right-hand portion of FIG. 3.

However, once the rollers 24, 26 of a follower 23 reach the suitably configurated non-convex portions of the respective tracks 27, 28, the aforementioned power train for a lever 9 approaching the laser 6 is activated in a sense that the lever 9 is first caused to pivot relative to the housing 18 in the direction of rotation of the drive shaft 22 (note the arrow 58 in FIG. 4) prior to being turned about the axis of the respective pivot 14 counter to the direction indicated by the arrows 57 and 58, namely in the direction of the arrow 59 shown in each of FIGS. 4 and 5. The configuration of those portions of the tracks 27, 28 on the fixed cam 29 which induce a pivoting of successive levers 9 in the direction of the arrow 59 is preferably such that the speed of rearward movement of the shaft 7 in the lever 9 at the treating station matches or at least very closely approximates the speed of the pivot 14 with the housing 18 (in the direction of the arrow 57).

As a lever 9 pivots relative to the rotating housing 18 under the combined action of the stationary cam 29 and the respective follower 23, the pinion 36 of the corresponding gear train 12 is caused to roll along the respective sun gear 34, i.e., the gear train 12 is activated in such a way that the receptacle 3 at the treating station rotates about the respective axis 8 through at least 360° while the receptacle is practically at a standstill, i.e., it does not share the movement of the housing 18 and of the pivots 14 in the direction of the arrow 57. The direction of rotation of a receptacle 3 at the treating station is shown in FIGS. 4 and 5, as at 60.

The offsets 44 compensate for eccentric mounting of the levers 9, and more specifically for radial deflection component of movement of the receptacles 3. Each offset 44 can be readily dimensioned in such a way that the radial displacement of a cigarette 2 (relative to the axis 13) during rotation with the respective receptacle 3 is zero or at least close to zero. This renders it possible to more accurately control the sizes of the perforations 5 which are being formed while the cigarette 2 rotates with the receptacle 3 relative to the stationary laser 6 and relative to the respective levers 9. As a rule, the offsets 44 render it possible to maintain the extent of stray movements of a cigarette 2 at the treating station to less than one tenth of one millimeter which is considered to be an acceptable range of tolerances.

FIGS. 4 and 5 show several different angular positions of a receptacle 3 ahead of, at, and beyond the treating station.

FIG. 5 further shows that the position of the axis 61 about which a receptacle 3 turns while dwelling at the treating station remains unchanged irrespective of the rotation of the receptacle at such station (three different angular positions of the receptacle 3 at the treating station are shown in FIG. 5 at P1, P2 and P3).

When the perforating operation upon the wrapper 4 of a cigarette 2 at the treating station is completed, the rollers 24, 26 of the respective cam 23 which orbits with the corresponding shaft 14 reach differently configurated portions of the respective tracks 27, 28 so that the lever 9 is caused to leave the treating station by pivoting relative to the rotating housing 18 in the direction of the arrow 62 (FIG. 4), and this returns the lever to a position shown in the left-hand portion of FIG. 3, i.e., again substantially radially of the housing 18 and shaft 22.

The tracks 27, 28 of the stationary cam 29 are or can be readily designed in such a way that the speed of orbital movement of the receptacles 3 reaches an optimum value during advancement past the cigarette receiving station upstream of the laser 6 (as seen in the direction of the arrow 57) and/or past the cigarette transferring or evacuating station downstream of the laser 6. The means for supplying untreated cigarettes 2 to the flutes of successive empty receptacles 3 can include a rotary drum-shaped conveyor having axially parallel peripheral flutes for cigarettes, and the means for receiving treated cigarettes from the conveyor 1 can also comprise a rotary drum-shaped conveyor having axially parallel peripheral flutes for cigarettes 2 having wrappers 4 provided with desired arrays of perforations 5.

An important advantage of the improved apparatus is that it can ensure the treatment of rod-shaped articles at a high frequency and with a high degree of accuracy and predictability. Another important advantage of the apparatus is that the articles are treated gently and that a selected portion of each article can remain fully exposed for monitoring and/or treatment through an angle of 360°, i.e., all the way around the periphery of the selected portion.

Though it is within the purview of the invention to provide a separate prime mover for the conveyor 1, for the means for temporarily moving the receptacles 3 in the direction of the arrow 59, and for the means for rotating the receptacles 3, the illustrated apparatus is preferred at this time because all mobile components receive motion from the shaft 22 for the housing 18 of the conveyor 1 with assistance (for the means for temporarily moving) from the fixed cam 29. Thus, the illustrated power train including the shaft 22, the pivots 14, the levers 9, the gear trains 12 and the shafts 7 ensures that all of the mobile parts are driven by the prime mover (not shown) for the shaft 22.

The levers 9 constitute a desirable but optional feature of the improved apparatus. For example, such levers could be replaced with a guide or carrier which movably supports the receptacles 3 and is coaxial with the shaft 22. This would obviate the need for discrete gear trains 12. However, the illustrated apparatus is preferred at the present time because the discrete levers 9 and the gear trains 12 therein render it possible to accurately select and synchronize the movements of the receptacles 3 in the direction of the arrow 59 with rotary movements in the direction of the arrow 60.

The mounting of the pivots 14 in the housing 18 of the conveyor 1, and the establishment of rigid connections between the pivots 14 and the respective followers 23 contribute to simplicity and compactness of the improved apparatus. The provision of the stationary cam 29 (particularly with plural tracks 27, 28) and the mounting of the cam in such a way that certain portions of its tracks have centers of curvature on the axis 13 contributes to simplicity, reliability and compactness of the apparatus. The same applies for the selection of levers 9 which include or constitute cases 11 for the respective gear trains 12.

The offsets 44 of the receptacles 3 are desirable and advantageous on the ground that they can fully compensate for the relatively small radial displacement of the shafts 7 relative to the fixed axis 13 during pivoting of the levers 9 relative to the housing 18, i.e., while the shafts 7 are caused to move in the direction of the arrow 59 in order to ensure that the article 2 being treated by the laser 6 is at a standstill as seen in the direction of the arrow 57. As mentioned above, the offsets 44 ensure that, when located at the treating station, the articles 2 are not caused to move radially of the axis 13.

An advantage of the pneumatic means for holding the articles 2 in the flutes of the respective receptacles 3 is that this reduces the likelihood of damage to the wrappers of the articles during transport toward, during dwell at, and during transport away from the treating station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating rod-shaped articles of the tobacco processing industry and, therefore, such adaptations should and are intended to be comprehended within the meaning and range of equivalence of the appended claims.

What is claimed is:

1. Apparatus for manipulating receptacles for elongated rod-shaped articles of the tobacco processing industry during transport of receptacles at an article treating station, comprising means for conveying the receptacles in a predetermined direction along an arcuate path at least substantially transversely of the elongated articles in the receptacles; means for temporarily moving the receptacles relative to the means for conveying counter to said direction at said station; and means for rotating the receptacles about longitudinal axes of the receptacles at least during temporary movement of the receptacles relative to said means for conveying.

2. The apparatus of claim 1, wherein said receptacles have flutes for rod-shaped articles.

3. The apparatus of claim 1, further comprising at least one unit disposed at said station and having means for influencing the permeability of tubular wrappers of the articles in the receptacles at said station.

4. The apparatus of claim 3, wherein said means for influencing includes at least one laser.

5. The apparatus of claim 1, wherein said means for rotating comprises means for rotating the receptacles through angles of at least 360°.

6. The apparatus of claim 1, wherein said means for conveying comprises means for orbiting said receptacles about a fixed axis so that said longitudinal axes are conveyed at a first speed, said means for temporarily moving including means for moving the receptacles counter to said direction so that said longitudinal axes are moved relative to said means for conveying at a second speed at least approximating said first speed whereby the positions of receptacles at said station, as seen in said predetermined direction, remain at least substantially fixed during rotation of the receptacles and of the articles therein about the respective longitudinal axes.

7. The apparatus of claim 1, wherein said means for conveying, said means for temporarily moving and said means for rotating together constitute an integral power train.

8. The apparatus of claim 7, wherein at least one of said conveying, moving and rotating means derives motion from another of said conveying, moving and rotating means.

9. The apparatus of claim 7, wherein said means for conveying includes means for orbiting said receptacles about a fixed axis and said means for temporarily moving includes at least one lever for each of said receptacles, said levers orbiting about said fixed axis and being pivotable relative to said means for conveying about further axes parallel to said fixed axis, said receptacles being rotatable relative to the respective levers about the respective longitudinal axes.

10. The apparatus of claim 9, wherein said means for conveying comprises a housing and drive means for rotating said housing about said fixed axis, said means for temporarily moving further including pivots defining said further axes and rotatably mounted in said housing, and a cam follower rigid with each of said pivots.

11. The apparatus of claim 10, wherein said means for temporarily moving further comprises a stationary cam having at least one track for said followers.

12. The apparatus of claim 11, wherein said cam has first and second tracks and each of said followers has first and second rollers respectively engaging said first and second tracks.

13. The apparatus of claim 1, wherein said means for temporarily moving includes at least one lever for each of said receptacles, said levers being pivotable relative to said means for conveying and rotatably mounting the respective receptacles, each of said levers including a case for a transmission of said means for rotating.

14. The apparatus of claim 13, wherein each of said transmissions comprises a gear train including a sun gear fixed to a pivot rockable with the respective lever relative to said means for conveying, and a further gear receiving torque from the sun gear and affixed to a shaft defining the longitudinal axis for the respective receptacle.

15. The apparatus of claim 1 for manipulating receptacles for elongated rod-shaped articles having longitudinally extending central axes, wherein said means for rotating includes shafts, at least one for each of said receptacles and each defining said longitudinal axis for the respective receptacle, said receptacles having means for maintaining the central axes of the articles therein in substantial parallelism with but offset relative to the respective longitudinal axes.

16. The apparatus of claim 1, wherein each of said receptacles comprises a pair of aligned sections and said means for temporarily moving comprises pairs of pivotable levers for said pairs of aligned sections and means for coupling the aligned sections of each receptacle to each other for synchronous pivoting with said levers.

17. The apparatus of claim 16, wherein said means for coupling comprises pivots fixed to said levers and rotatably mounted in said means for conveying, and means for non-rotatably connecting the pivots for each pair of levers to each other.

18. The apparatus of claim 1, wherein said means for conveying comprises a drum rotatable about a fixed axis and carrying at least a portion of said means for temporarily moving, said means for rotating and said receptacles.

19. The apparatus of claim 1, wherein said means for temporarily moving comprises means for pivoting said receptacles relative to said means for conveying in said predetermined direction prior to movement counter to said direction.

20. The apparatus of claim 1, wherein said receptacles include means for pneumatically holding the articles for movement along said arcuate path.

* * * * *